US006400898B1

(12) United States Patent
Hawkins et al.

(10) Patent No.: US 6,400,898 B1
(45) Date of Patent: Jun. 4, 2002

(54) WHEELED LARGE SURFACE THERMOGRAPHIC INSPECTION HEATING APPARATUS WITH UNIFORM HEATING

(75) Inventors: Gary F. Hawkins, Torrance; Eric C. Johnson, Rancho Palos Verdes; James P. Nokes, Torrance, all of CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 09/693,097

(22) Filed: Oct. 18, 2000

(51) Int. Cl.[7] ..... H05B 3/00

(52) U.S. Cl. ..... 392/407; 392/415; 392/432; 392/422; 219/533; 432/229

(58) Field of Search ..... 392/407, 415, 392/432, 422, 409–414; 219/533; 37/227, 230; 405/131; 404/95, 79; 432/227, 229; 34/270, 266

(56) References Cited

U.S. PATENT DOCUMENTS

| | | | | | |
|---|---|---|---|---|---|
| 2,761,948 | A | * | 9/1956 | Todd | 392/415 |
| 3,400,244 | A | * | 9/1968 | Meltzer | 392/407 |
| 3,912,902 | A | * | 10/1975 | Herniter | 219/228 |
| 4,533,423 | A | * | 8/1985 | Johnson et al. | 156/359 |
| 4,806,194 | A | * | 2/1989 | Wald | 404/95 |
| 4,856,700 | A | * | 8/1989 | Sakaguchi et al. | 392/415 |
| 5,140,762 | A | * | 8/1992 | Monson | 37/227 |
| 5,590,238 | A | * | 12/1996 | Ericson | 392/415 |
| 5,659,657 | A | * | 8/1997 | Overdorf | 392/422 |
| 5,948,299 | A | * | 9/1999 | Scalia | 219/228 |

FOREIGN PATENT DOCUMENTS

| | | | |
|---|---|---|---|
| CH | 609400 | * | 2/1979 |
| DE | 3615869 | * | 11/1987 |
| GB | 419618 | * | 11/1934 |
| GB | 667178 | * | 2/1952 |
| GB | 2211530 | * | 7/1989 |
| JP | 9-256307 | * | 9/1997 |

* cited by examiner

*Primary Examiner*—John A. Jeffery
(74) *Attorney, Agent, or Firm*—Derrick Michael Reid

(57) ABSTRACT

A heater preferably having a plurality of equally spaced heating elements, such as heating lamps, provides a uniform heat radiation pattern for quickly and uniformly heating a large surface area using motor controlled wheels for translating the heater at a constant rate of speed across the surface of a structure in a desired pattern. The heater having a handle for operator manipulation for guiding and turning the heater in the desired pattern. The heater, having a wide lateral distance for radiating a wide uniform radiation pattern is suitable for thermographic application for imaging the heated surface and detecting subsurface defects in the structure, such as composite overwrapped concrete bridge and building structures subject where debonding of the composite/concrete interface is a concern.

10 Claims, 3 Drawing Sheets

LARGE AREA HEATER

LARGE AREA HEATER

HEATING ELEMENT HEAT PROFILE

BOUSTRO-PHODONDRICK PATTERN

STRUCTURE HEATING DEFECT DETECTION PROCESS

LAMP HEATER

GAS BURNER HEATER

WHEELED LARGE SURFACE THERMOGRAPHIC INSPECTION HEATING APPARATUS WITH UNIFORM HEATING

REFERENCE TO RELATED APPLICATION

The present application is related to applicant's copending application entitled Large Surface Thermographic Inspection Method, Ser. No. 09/691,558, filed Oct. 18, 2000, by the same inventors.

FIELD OF THE INVENTION

The invention relates to the field of thermographic inspection. More particularly, the present invention relates to the uniform heating of large surfaces for thermographics inspection for defects in large structures.

BACKGROUND OF THE INVENTION

Composite materials are being used to overwrap concrete columns and other concrete support structures in bridges and buildings for seismic reinforcement and/or structural rehabilitation. There are different manufacturing methods for applying composite overwraps. Each method has the potential for creating debonds at the composite overwrap to concrete interface. If a significant portion of the composite is debonded, the overwrap needs to be repaired or stripped off and reapplied.

An extensive survey of many nondestructive evaluation techniques has shown thermography to be a viable method for detecting debonds beneath composite overwraps. A thermographic inspection method typically involves two phases, a heating or cooling phase where a thermal gradient is induced through the thickness of the test article, and a monitoring phase where an infrared camera measures the test article surface temperature as the test article cools. Underlying defects, such as debonds and porous cavities, result in localized thermal conductivity deviations that give rise to hot or cold spots on the test article surface after the surface has been thermally treated. The Infrared camera can then be used to indicate the location, shape and approximate size of a surface region above each flaw. In some instances, the time required for the indication to develop can also be used to estimate the flaw depth. Infrared camera technology has progressed to the point that cameras of suitable thermal and spatial resolution are now in a package that is easily held by hand. However, the limiting factor for conveniently and quickly performing thermography often falls upon the method of establishing the thermal gradient. The thermal gradient can be established by various apparatus. It is important that the surface of the test article be uniformly warmed or cooled. It is particularly difficult to carry this out in a controlled and repeatable fashion when the test article surfaces are large. Single point heating sources such as flash lamps, spotlights and heat guns do not provide uniform heating across a wide area. Thermal blankets are cumbersome to manipulate and the application of hot water in a controlled fashion can be difficult. These and other disadvantages are solved or reduced using the invention.

SUMMARY OF THE INVENTION

An object of the invention is to provide an apparatus for uniformly heating a large surface through thermal radiation.

Another object of the invention is to provide a uniform rapid heating of a large surface through thermal radiation.

Still another object of the invention is to provide an apparatus that is easy to use by human beings for uniformly quickly heating a large surface through thermal radiation.

Yet another object of the invention is a method for thermographic detection of defects in large structures having large exterior surfaces heated by an apparatus that uniformly heats the large surfaces through thermal radiation.

The present invention is directed to an apparatus that radiates a uniform amount of thermal energy upon a large surface in a short period of time using manual manipulation. The heating apparatus is designed to be used as part of a thermographic inspection method in which an infrared imaging camera is used for thermographically inspecting large structures, such as large concrete structures overwrapped with composite. Although many of the effects of nonuniform heating can be removed through postprocessing of the thermal data, it is much more convenient and much less complicated if such postprocessing does not need to be performed. With acceptable unprocessed real time data, an operator can quickly outline the flaws or defects in the large structure at the time of the inspection, and repairs can be initiated immediately. To the greatest extent possible, the heating system should be hand deployable and manipulable. Handheld equipment is advantageous because anything that needs to be set on the ground or fixed to a structure must be adapted to the terrain around the area of inspection. The terrain can vary from pylons underneath piers to scaffolding hundreds of feet above the ground. There is also the consideration of setup time. Time spent setting up equipment only adds to the cost of the inspection. In the preferred form, the heating equipment heats a large surface with a uniform heat radiation pattern that can be conveniently applied by an operator manipulating the heating apparatus, and shortly thereafter, imaged by a hand held infrared camera for quickly detecting subsurface flaws. These and other advantages will become more apparent from the following detailed description of the preferred embodiment.

DETAILED DESCRIPTION OF THE PREFERRED EMBODIMENT

Figure 1:
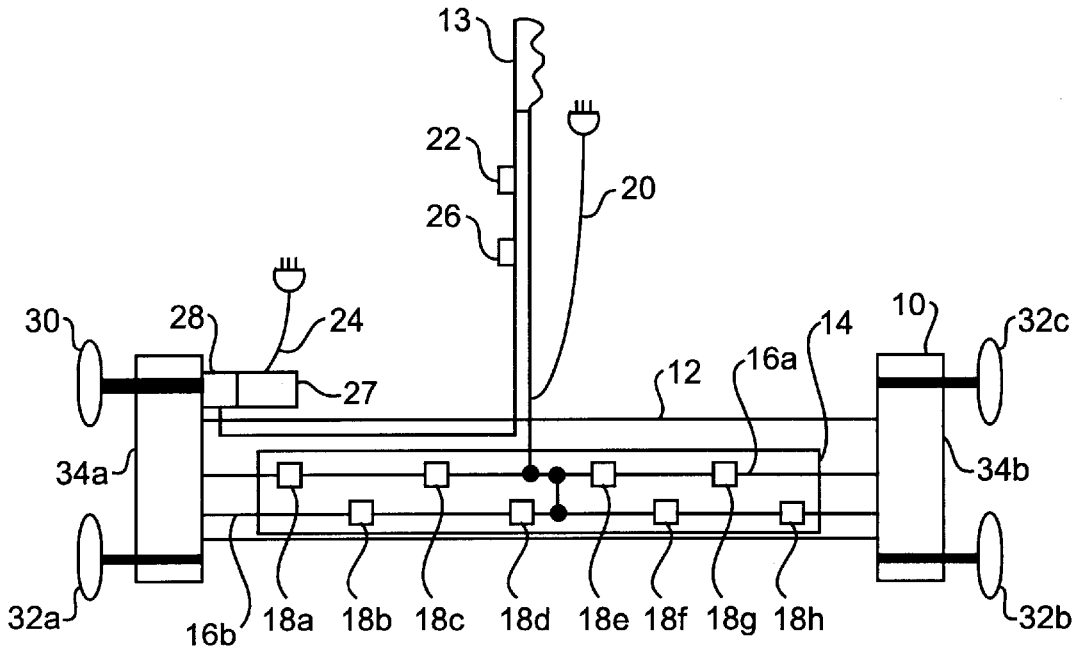
FIG. 1 depicts a large area heater having two strips of heating elements.

An embodiment of the invention is described with reference to the figures using reference designations as shown in the figures. Referring to FIG. 1, a large area heater 10 is shown having a wide elongated housing 12 with an orthogonally attached handle 13. Within the housing 12 is disposed a parabolic reflector 14 extending the length of the housing 12. A handle 13 is attached to the housing 13. The handle 13 may include a rubber grip for manual manipulation by a human being, an extension pole for manipulating the direction of travel of the heater 10, and may further include a swivel attachment joint, not shown, for rotating the handle 13 relative to the housing 12 for rotating and elevating handle 13 to a comfortable position for the operator of the heater 10. The heater 10 is manipulated by an operator to control the direction of travel by applying slight left and right pressure upon the handle 13.

Within the housing 12 is preferably disposed first and second strip heaters 16*a* and 16*b*, respectively, including heating elements 18a, 18*c*, 18*e* and 18*g*, and 18*b*, 18*d*, 18*f* and 18*h*, respectively. The heating elements 18*a*, 18*c*, 18*e* and 18*g*, and heating elements 18*b*, 18*d*, 18*f* and 18*h*, are preferably equally spaced apart along the respective strip heaters 16*a* and 16*b*. The housing 12 houses the inline heating elements 18*abcdefgh* while the reflector 14 reflects the heat from the elements 18*abcdefgh* towards a large area surface, not shown. The width of the housing 14 and staggered inline heated elements 18*abcdefgh* determines lateral distance that should be as wide as practicable to decrease the time to heat a given area of the large area surface. The elements 18*abcdefgh* heat the large area surface through thermal radiation. The housing 12 can be shaped so as to facilitate heating of flat surfaces like those of rectangular bridge columns or curved surfaces like those of cylindrical bridge columns. Various preferred configurations include at least one heating strip with a plurality of equally spaced heater elements 18*abcdefgh* that radiate heat and heat the large area surface. The heating elements 18*abcdefgh* receive electrical power through a heater power cord 20 and the amount of power, and hence, the amount of radiant heat generated by the heating elements 18*abcdefgh* is controlled by a heater controller 22 preferably having a simple rotating knob, not shown. A motor power 24 is used to provide electrical power through a speed controller 26 for adjusting the speed of a drive wheel 30. The speed controller is used to adjust the revolution per minute of the drive 30 for moving the heater 10 at a constant speed over a large area surface, not shown, during heat treatment. Three other wheels 30*a*, 30*b* and 30*c* combine with drive wheel 30 for stabilizing the heater upon the large area surface while enabling controlled constant speed movement across the large area surface while the heater 10 is directionally manipulated by the operator to heat the large area surface. The four wheels 30 and 32*abc* are attached to the housing 12 through two side frames 34*a* and 34*b* for providing stabilized axle rotation of the wheels 30 and 32*abc*.

The use of thermal radiation across a wide lateral distance moved across the large area surface offers substantially uniform heating at a reasonable cost at higher speed. The uniform surface heating is Obtained by applying heat along a line and translating that line of heat at a constant rate. The heat energy applied to any point is a function of the heat flux from the multiple heater strips 16*ab* providing a level of power to the inline heater elements 18*abcdefgh* and a function of the translation rate controlled by the speed controller 26. The wheel drive motor 28 is preferably driven by a clock drive type motor controller 26 to set the rate of translation of the inline heating elements 18*abcdefgh* through a desired heating pattern.

Figure 2:
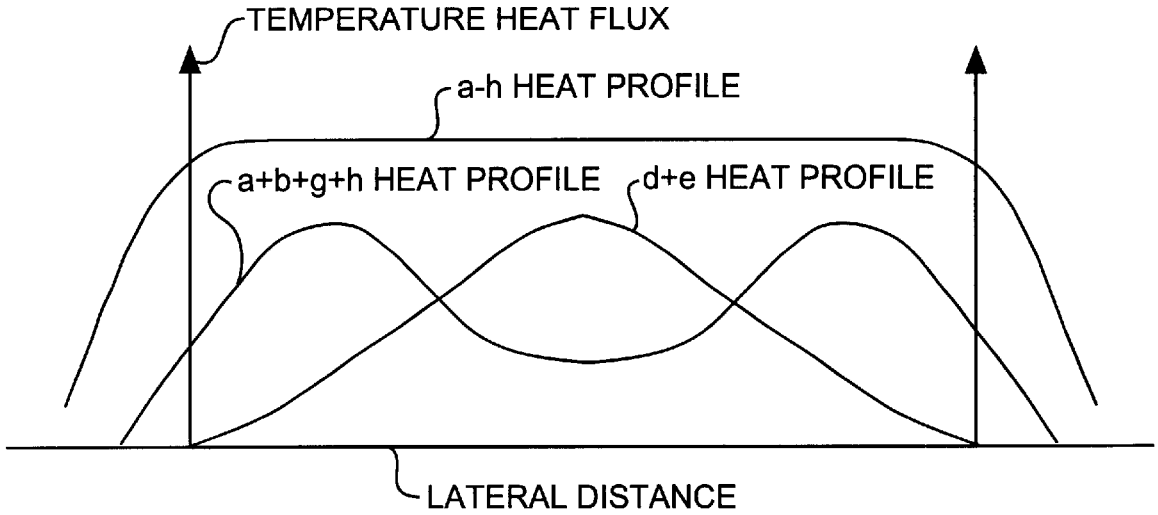
FIG. 2 depicts heating profiles of a large area heater having differing number of placement of heating elements.

Referring to FIGS. 1 and 2, and more particularly to FIG. 2, various preferred configurations of the heater 12 include at least one heating strip, for example heating strip 16*a*, with a plurality of equally spaced heater elements, such as elements 18*aceg* to preferably provide a constant heat radiation pattern. For example, when elements 18*abcdefgh* are used, an a–h heat profile is generated having a constant heat radiation heat profile across the lateral distance of the heater housing 12. Multiple heating strips, such as 16*a* and 16*b* increase the heat radiation level for faster heating the large surface area. When only, for example, heating elements 18*abgh* are used on distal and proximal ends of the housing 12, an unpreferred double peak a+b+g+h heat profile radiation pattern is generated. When only, for example, center heating elements 18*ed* are used, a single peak d+e heat profile radiation pattern is generated. The unpreferred a+b+g+h double peak and d+e single peak heat profiles provide nonconstant heat profiles resulting in uneven heating of the large surface area. While post computer processing may account for such uneven heating, it is preferred that the large surface area be heating by the constant level a+b+c+d+e+f+g+h heat profile be used so that the large surface area is evenly heated thereby providing a constant temperature background during thermographic defect detection.

The thermal elements 18*abcdefgh* need to be capable of distributing up to 20 K-Joule of thermal energy over a meter$^2$ area per second, that is, 5000 watts along a 0.5 m line traveling at a constant speed of 0.5 m/sec. This level of energy flux may be necessary to heat the large surface area of a structure under test so as to reveal detectable flaws well below the large surface area. The heating rate derives from good thermographic practices that require that the heat be applied in a time that is short compared to the thermal transit time across the material of the structure under thermography testing. The heater 10 should be constructed to be light as possible so it can be located on the end of the handle 13 and easily manipulated by the operator. In practice, an operator guides the handle 13 as the clock driven wheel 30 and 30*abc* define the speed of the inline heat elements and the distance from the surface being heated. Both the heat output of the inline heat elements 18*abcdefgh* and the rate of the clock drive are controllable so that wide ranges of total heat fluxes are possible.

There are at least two means for applying the inline radiant heat from the heating elements 18*abcdefgh*, including the use of inline heat lamps or inline gas powered line heaters. Heat lamps are preferred as the easiest when a suitable source of electrical power is available. Generator type power supplies, not shown, may be preferably used to supply required power for the wheel drive motor 28 and heating elements 18*abcdefgh*. In the absence of such an electrical power source, a gas powered wheel drive motor 28 and gas powered inline heater elements may be alternatively used. To produce a suitable constant radiant heat profile using inline heating elements 18*abcdefgh*, high 100–500 Watt heat lamps are preferably used in the staggered linear array formed by heater strips 16*a* and 16*b*. This exemplar heating array is cost effective to build. Relatively simple electrical circuits can be used in the heat controller 22 to adjust and limit the heat output of the lamps 18*abcdefg* so that the operator can change the heat flux level as desired. The individual lamps are equally spaced apart so that the heat output is uniform along the lateral length of the heater housing 12. The ends of lamps may be overlapped to minimize any heat flux variations between the lamps. The extent of overlapping is a function of the type and size of lamp. The amount of spacing may be determined experimentally by determining the pattern of flux of one lamp and analytically determining the distance between the next lamp that maximizes the uniformity between the lamps arranged in the staggered inline pattern providing the uniform constant level heat profile. As an alternative, at least one substantially elongated heating lamp, not shown, may be used in place of the strips 16*ab* of heating lamps 18*abcdefgh*, however, such an elongated lamp may not provide the necessary desired level of heat flux thereby requiring an excessive number of parallel elongated lamps.

Gas type heating elements may include gas heated jet tubes or gas heated ceramic tubes to circumvent the need for an electrical power source at the thermography inspection site. Gas burners inside the tubes provide a soft long flame. Heat transfer takes place from the combustion gases to the tube. The tube then radiates directly to the surface or to the reflector 14 that focuses the energy onto the surface. A conventional ventilator, not shown, disposed at one end of the tubes 18abcdefg removes the combustion gases. The operator preferably has control of the heat flux by regulating the gas flow into the burner elements where the controller 22 is a gas flow controller and the power source 20 is a gas supply. This gas type heater form of the invention should also be lightweight and portable so that the gas type heater can be mounted on the handle 13 to be guided by an operator. The gas source can be placed on the ground with a feed line, not shown, running up the pole of the handle 13, or otherwise, a small portable gas supply could be attached to the heater 10 on handle 13.

Figure 3:
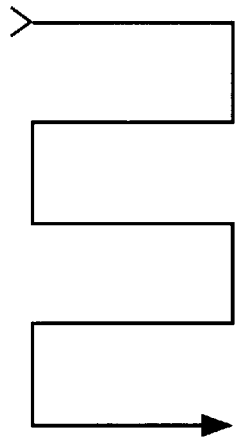
FIG. 3 depicts a boustro-phodondrick surface heating pattern.
Figure 4:
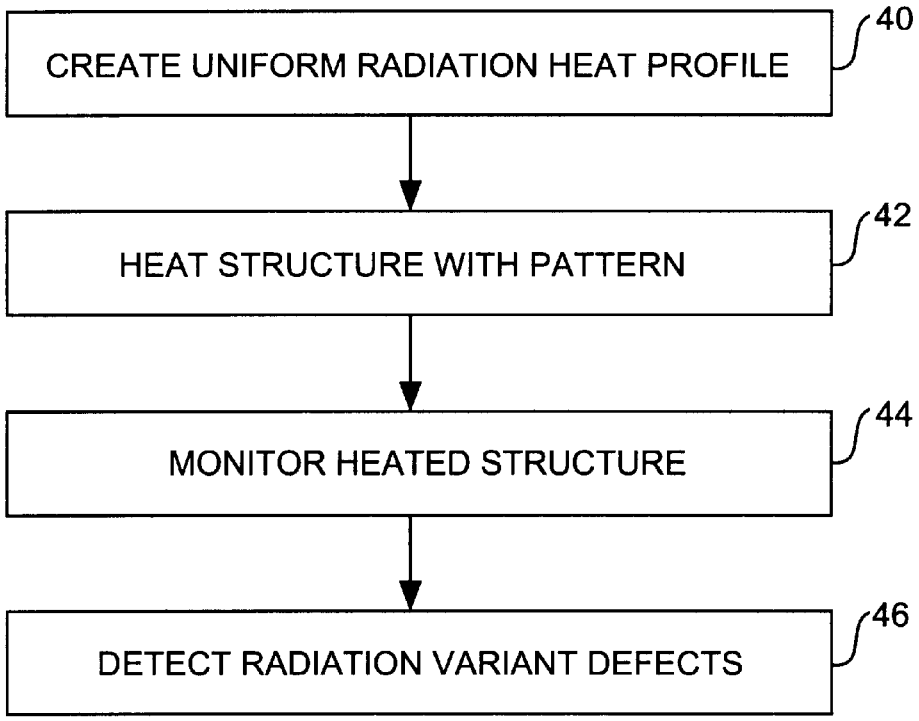
FIG. 4 is a thermographic inspection flow diagram.

Referring to all of the Figures, and more particularly to FIG. 3, a heater 10 is used by an operator to create 40 a uniform radiation heat profile across the substantially wide lateral distance. The operator manipulates the heater to heat 42 a large surface area of a structure along a desired heating pattern. Conventional thermography monitoring 44 is applied to image the heated surface and imaged variants in imaged heat radiation from the surface are used to detect 46 underlying defects in the structure. Those skilled in the art of thermography are well practiced to detect defects, such as debonding in composite structures.

Figure 5A:
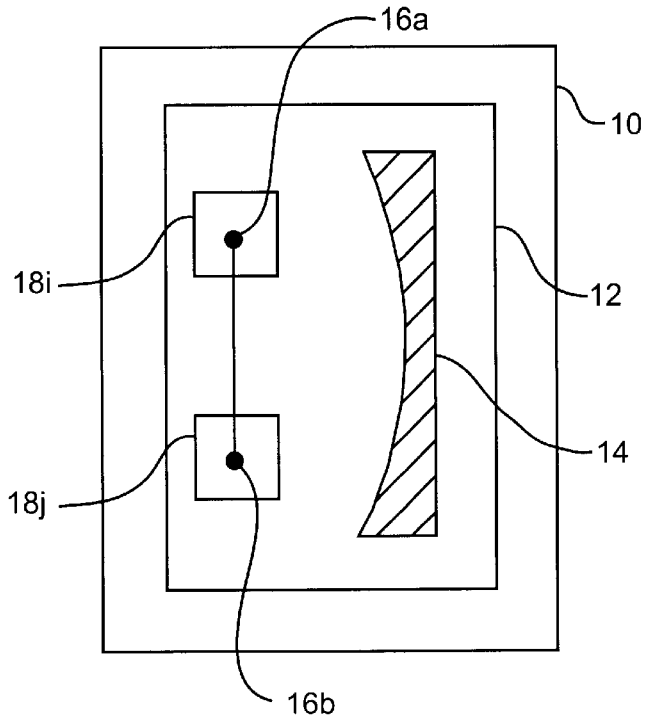
FIG. 5A depicts a lamp heater.
Figure 5B:
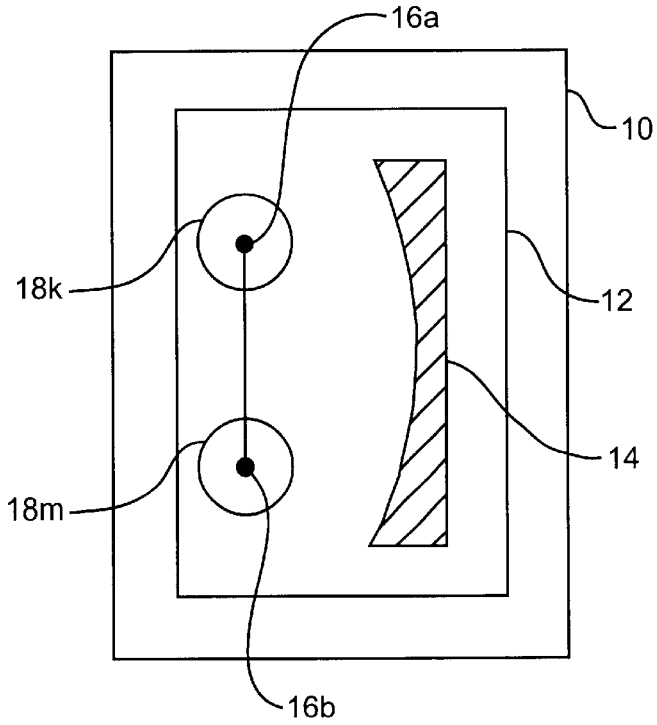
FIG. 5B depicts a gas burner heater.

In FIG. 5A, the two strips 16*a* and 16*b* are two rows of lamp heaters 18*i* and 18*j*, respectively, disposed in front of the parabolic reflector 14 in the housing 12 of the heater 10. In FIG. 5B, the two strips 16*a* and 16*b* are two rows of gas burner heaters 18*k* and 18*m*, respectively, disposed in front of the parabolic reflector 14 in the housing 12 of the heater 10.

The present invention is characterized by a heater having a wide later distance to quickly and uniformly heat the large surface area using thermal radiation for improved thermography inspection of a composite structure for the detection of subsurface defects, such as composite debonding. Those skilled in the art can make enhancements, improvements, and modifications to the invention, and these enhancements, improvements, and modifications may nonetheless fall within the spirit and scope of the following claims.

What is claimed is:

1. A heater for heating a surface, the heater comprising, a heating element for providing a uniform heat profile across the later distance of the heater for radiating uniform heat across a lateral distance of the heater, the heating element is a set of inline heating elements equally spaced apart across the lateral distance of the heater for uniformly heating the surface under the lateral distance of the heater, the heating elements providing a nonuniform heat profile in a traverse direction, a set of wheels for translating the heater upon the surface, a power source for supplying power to the heating element, a wheel motor for driving the set of wheels, and a wheel motor controller for controlling the wheel motor for controlling the rotational rate of the set of wheels for translating the heater across the surface at a constant rate of speed in the traverse direction.

2. The heater of claim 1 wherein, the heating element is a heat lamp heating element, and the power source is an electrical power source.

3. The heater of claim 1 wherein, the heating element is a set of gas burning heating elements.

4. The heater of claim 1 wherein, the heating element is a plurality of sets of strips of staggered inline heating elements.

5. The heater of claim 1 wherein the power source is an electrical power source, the heater further comprising, a heater controller powered by the power source, the heater controller for controlling a level of the uniform heat profile for controlling an amount of the uniform heat from the heating element.

6. The heater of claim 1, wherein the power source is a portable battery.

7. The heater of claim 1, wherein the power source is a portable electrical power generator.

8. The heater of claim 1, further comprising, a handle for manipulation by an operator for turning the heater in desired left or right directions by application of left or right manual force upon the handle.

9. The heater of claim 1 further comprising, a housing for supporting the heating element, and a reflector disposed within the housing for focusing radiant heat from the heating element upon the surface.

10. A heater for heating a surface, the heater comprising, a power source for supplying electrical power, a heating element for providing a uniform heat profile for radiating uniform heat across a lateral distance of the heater, the heating element is a plurality of sets of strips of staggered inline heating lamps equally spaced apart across the lateral distance of the heater, the heating element being powered by the power source, a heater controller for controlling a level of the uniform heat profile for controlling an amount of the uniform heat from the heating element, the heater controller powered by the power source, a housing for supporting the heating element, and a reflector disposed within the housing for focusing radiant heat from the heating element upon the surface, a set of wheels for translating the heater upon the surface, a wheel motor for driving at least one wheel of the set of wheels, the power source providing electrical power source to the wheel motor, a wheel motor controller for controlling the wheel motor for controlling the rotational rate of set of wheels for translating the heater across the surface at a constant rate of speed in a traverse direction, the motor controller being powered by the power source, the heating elements providing a nonuniform heat profile in the traverse direction, and a handle for manipulation by an operator for turning the heater in desired left or right directions by application of left or right manual force upon the handle for translating the heater in a desired pattern across the surface.

* * * * *